US006237638B1

(12) United States Patent
Asta et al.

(10) Patent No.: US 6,237,638 B1
(45) Date of Patent: May 29, 2001

(54) MANIFOLD ASSEMBLY FOR A GAS RANGE

(75) Inventors: Joseph L. Asta, Des Plaines; David A. Casolari, Arlington; Patrick J. Anderson, Aurora, all of IL (US)

(73) Assignee: Harper-Wyman Company, Aurora, IL (US)

( * ) Notice: Subject to any disclaimer, the term of this patent is extended or adjusted under 35 U.S.C. 154(b) by 0 days.

(21) Appl. No.: 09/603,170

(22) Filed: Jun. 26, 2000

(51) Int. Cl.[7] ..... F16K 11/40
(52) U.S. Cl. ..... 137/883; 126/39 N
(58) Field of Search ..... 137/883; 126/39 N; 251/145

(56) References Cited

U.S. PATENT DOCUMENTS 2,086,125 * 7/1937 Ewing ..... 126/39 N
2,896,975 7/1959 Wahl et al. .
5,979,430 11/1999 Peed et al. .

OTHER PUBLICATIONS

Catalogue, Harper 7060 and 7062 Series; before Jan. 1, 1999.

* cited by examiner

*Primary Examiner*—John Fox
(74) *Attorney, Agent, or Firm*—Mason, Kolehmainen, Rathburn & Wyss; Philip M. Kolehmainen

(57) ABSTRACT

A manifold tube is formed from a straight length of thin wall tube initially having a uniform circular cross section. A first segment of the tube is left in its initial circular cross section configuration. The first segment includes an inlet end of the tube. A second segment of the tube is flattened to form opposed flat wall portions spaced apart by a distance smaller than the diameter of the circular portion and separated by side walls spaced apart by a distance greater than the diameter. An inlet fitting is attached to the inlet end of the tube. A bend is formed in the first segment of the tube between the inlet end and the second segment. Burner valves and on oven control valve are secured with metal-to-metal contact to the flat wall portions in the second segment of the tube.

21 Claims, 3 Drawing Sheets

MANIFOLD ASSEMBLY FOR A GAS RANGE

FIELD OF THE INVENTION

The present invention relates to a gas distribution manifold assembly for a gas cooking range.

DESCRIPTION OF THE PRIOR ART

A typical gas range has at least one, and usually several, top burners and may also have an oven burner. A manifold assembly is used to distribute gas from a gas inlet to the burners through valves, including burner valves for the top burners and a thermostatic control valve for the oven burner.

A manifold assembly of a type that was widely used in the past includes a round thick wall tube or pipe having a circular cross section. The wall of the tube or pipe is thick and strong enough to permit components of the assembly to be attached directly to the wall by threaded connections. Thus, an inlet end of the tube or pipe is threaded to mate with a gas supply fitting, and the other end of the tube or pipe is closed, for example by a cap or a plug threaded onto or into the pipe. Burner valves are attached directly to the wall of the tube or pipe, typically by threading a nipple of the valve body into a female threaded hole formed in the wall of the tube or pipe. Because of the configuration of a typical range, the tube or pipe may require at least one bend or elbow along its length.

This type of manifold assembly is heavy and expensive due to its massive wall thickness and the number of parts and assembly operations required for its manufacture. To overcome these disadvantages, the modern trend is to make manifold assemblies using thin wall tubing instead of thick wall pipe or tube. Various approaches have been employed, but none has fully met the need for a manifold assembly that is low in cost and easy to assemble.

One approach is to use a thin wall round tube having a circular cross section throughout its length. One advantage is that a round tube is low in cost. Another advantage is that a round tube can be easily formed with one or more bends using readily available numerically controlled equipment, and the bends can be relatively sharp, with a small radius of curvature. Thin wall round tubing has problems however. Thin wall tubing does not permit the direct attachment of threaded inlet fittings and caps to the ends of the tube because the material is not sufficiently thick and strong. Typically therefore the inlet end of the thin wall tube has a machined inlet fitting welded in place and the opposite end is closed by a welded in place plug or by pinching the tube wall. It is difficult to mount burner and thermostat oven control valves to a tube wall having a circular cross section. Because the tube wall is not thick enough to accept threaded nipples, the valves are attached by a fastener system, and it is difficult to fasten valve bodies to a circular surface. A saddle arrangement or other complex structure and/or difficult assembly operation is required to reliably mount valve bodies to a round thin wall tube.

In an attempt to overcome problems with a tube having a circular cross section, tubes with flat walls have been employed. One known manifold assembly is made with a thin wall tube having a square cross section throughout its length. Another known manifold assembly uses a flattened thin wall tube with opposed curved side walls and opposed flat top and bottom walls through out its length. Flat walls have the advantage that it is easier to mount valves to a flat surface than to the curved surface of a round tube. However the flat wall tubes have other problems. It is difficult to form a bend in a square or flattened tube. Such a tube cannot be shaped into a sharp, small radius bend. In addition, such tubes can only be bent in limited ways. A bend in a plane that is not parallel or perpendicular to the flat tube wall is not practical. Finally, it is difficult to attach an inlet fitting or a cap or plug to the end of a thin wall tube having a non-circular cross section.

U.S. Pat. No. 2,896,975 discloses a pipe manifold using a round pipe with a thick wall section strong enough to receive a threaded valve nipple. At locations where valves are to be attached, the pipe is deformed to reinforce the pipe. The deformed segments include flattened, angled side walls and a flat top wall.

U.S. Pat. No. 5,979,430 discloses a manifold having tube portions of square cross section. The ends of the square tube are deformed outwardly by a mandrel to an enlarged diameter round shape that can accept round plugs to seal the tube ends. In addition, prior to the present invention, Harper-Wyman Company has made and sold Harper 7060 and 7062 Series manifold assemblies using square thin wall tube.

SUMMARY OF THE INVENTION

A principal object of the present invention is to provide an improved manifold assembly for a gas range that performs well and is inexpensive to manufacture. Other objects are to provide an improved manifold assembly having a thin wall tube to which valves can be attached without using saddles or the like; to provide an improved manifold assembly having a tube that can be formed with sharp bends in any plane and that can include compound bends; to provide an improved manifold assembly which can accept a simple round inlet fitting; to provide an improved end closure for the tube of a manifold assembly; to provide an improved thin wall tube structure for use in a gas range manifold assembly; to provide an improved method for making a manifold assembly and manifold tube; and to provide a manifold assembly overcoming disadvantages of known manifold assemblies.

In brief, in accordance with the invention there is provided a manifold assembly for a gas range. A thin wall metal tube forms an elongated gas conduit having an inlet end and a closed end. At least one valve is mounted on the conduit for controlling the flow of gas from the conduit. The tube has a first segment along its length, the first segment having a circular cross section with a diameter. The tube has a second segment along its length, the second segment having a non-circular cross section with opposed first and second wall portions alternating with opposed third and fourth wall portions. The first and second wall portions are flat and parallel to one another and are spaced apart by a distance less than the diameter of the first segment. The third and fourth wall portions are spaced apart by a distance larger than the diameter of the first segment. The valve is mounted to the second segment of the tube.

BRIEF DESCRIPTION OF THE DRAWING

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figures 1, 2, 3, 4, 5:
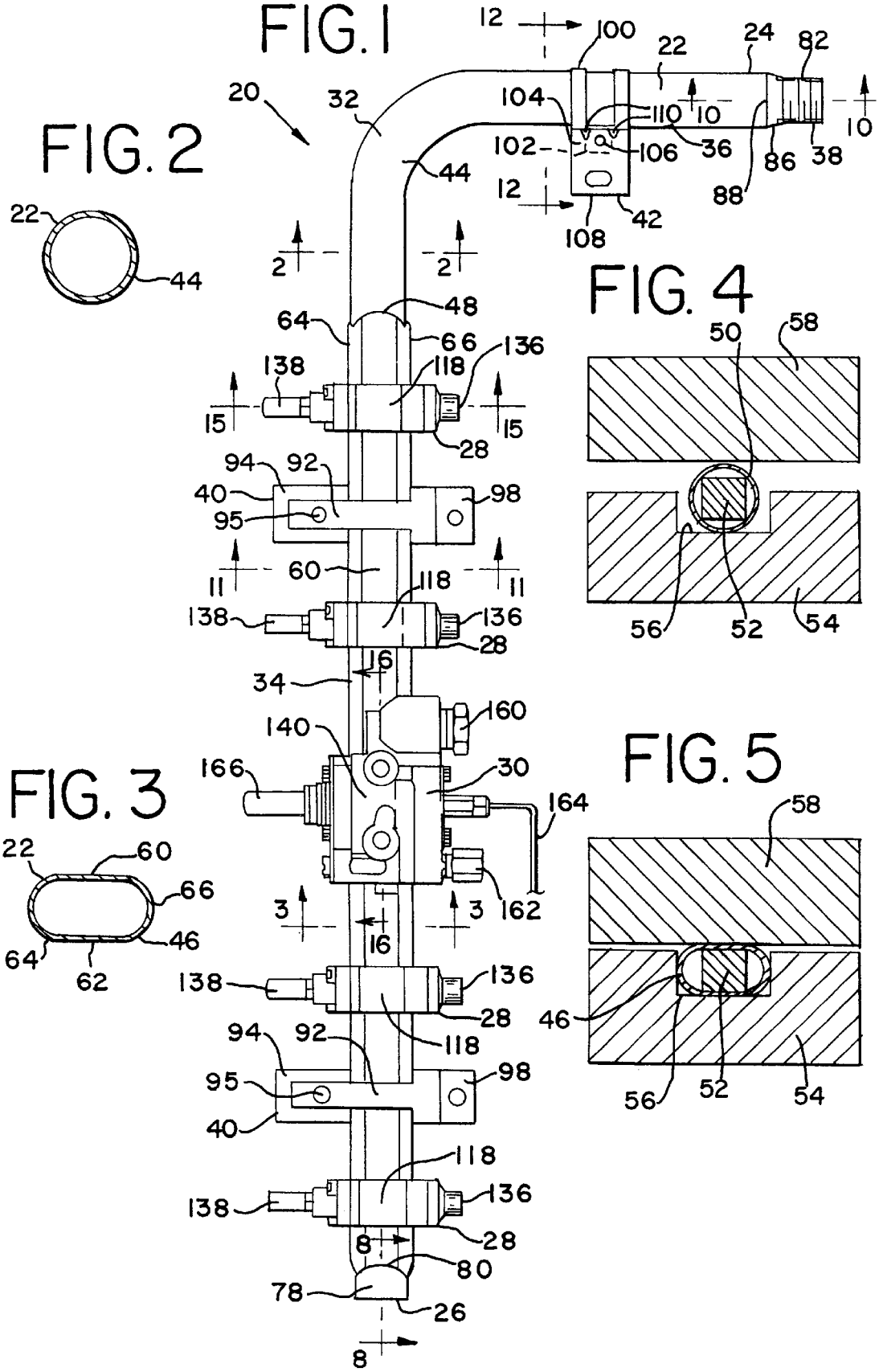
FIG. 1 is a top plan view of a manifold assembly for a gas range constructed in accordance with the present invention.
FIG. 2 is an enlarged cross sectional view of the manifold tube of the manifold assembly taken along the line 2—2 of FIG. 1.
FIG. 3 is an enlarged cross sectional view of the manifold tube of the manifold assembly taken along the line 3—3 of FIG. 1.
FIG. 4 is a cross sectional view of the manifold tube and of tools for flattening a segment of the tube, shown prior to the flattening operation.
FIG. 5 is a view of the manifold tube and tools of FIG. 6, shown at the completion of the flattening operation.

Having reference now to the drawings and initially to FIG. 1, there is illustrated a manifold assembly generally designated as 20 and constructed in accordance with the principles of the present invention. The manifold assembly 20 is used in a gas cooking range (not shown) to distribute gas from a gas supply to four top burners and an oven burner. The principles of the invention can be applied to manifold assemblies for gas cooking ranges of other configurations, including for example ranges with a different number of top burners and ranges without an oven burner. In general, the manifold assembly 20 includes a manifold tube 22 having an inlet end 24 and a closed end 26. For controlling the supply of gas to the range top and oven burners, the manifold assembly 20 includes four burner valves 28 and a thermostatic oven control valve 30.

The manifold assembly 20 is configured for use in a range having a rear entry gas supply and front panel mounted controls. As a result the manifold tube 22 has a bend 32 interconnecting a front tube portion 34 and a rearwardly extending tube portion 36. An inlet fitting 38 is attached to the inlet end 24 of the manifold tube 22. To support the manifold assembly 20 in a gas range, it includes a pair of forward mounting brackets 40 and an inlet section mounting bracket 42.

In accordance with the invention, the manifold tube 22 has segments with different cross sections. A first segment 44 has a uniform circular cross section throughout its length, as seen in FIG. 2. A second segment 46 has a uniform non-circular cross section throughout its length, as seen in FIG. 3. The circular segment 44 extends from the inlet end 24 of the manifold tube along the entire rearwardly extending portion 36 and along the entire bend 32 to the front tube portion 34. The non-circular segment 46 constitutes nearly all of the front tube portion 34. The circular and non-circular segments 44 and 46 are joined by a short transition region 48 near the upstream end of the front tube portion 34. Bracket 42 and inlet fitting 38 are mounted to the circular segment 44, while the valves 28 and 30 as well as the brackets 40 are mounted to the non-circular segment 46.

Figure 6:
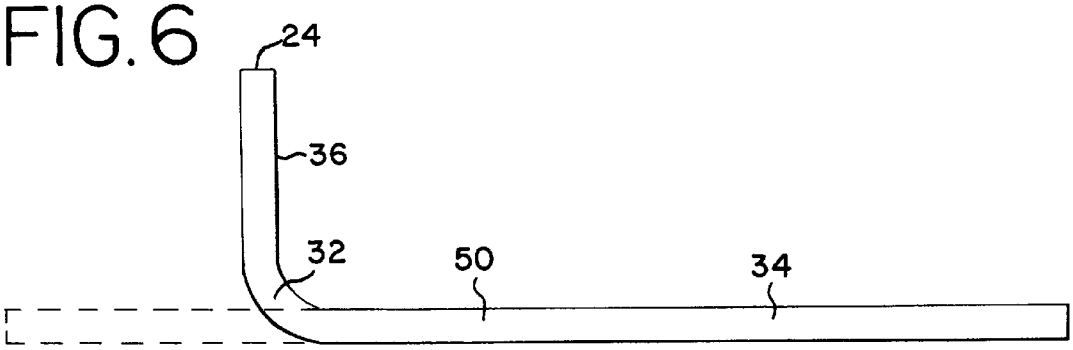
FIG. 6 is top plan view of the manifold tube in a preliminary stage in the process of manufacturing the manifold tube.

The manifold tube 22 is made from a straight length of thin wall metal round tube 50 seen in broken and full lines in FIG. 6. A sequence of steps in the method of making the tube 22 from the tube 50 is described with reference to FIGS. 4–7. In a preferred embodiment of the invention, the tube 50 is an aluminized steel tube having an outer diameter of about three-quarters of an inch, and having a uniform twenty gauge wall thickness of about 0.034 inch throughout its length. The term "thin wall" means a tube wall thickness less than 0.10 inch that is not sufficiently thick and strong for the direct attachment of valves and the like with threaded connections. Initially the tube 50 is straight and has a uniform wall thickness and a uniform circular cross section throughout its length. The cross section of the tube 50 as initially supplied is the same as the cross section seen in FIG. 2. Round thin wall tube of this type has the advantage that it is inexpensive.

The first step in the method of manufacturing the manifold assembly 20, as indicated in FIG. 4, is to bend the straight tube 50 and thus create the bend 32 separating the front and rearwardly extending tube portions 34 and 36. The initial, straight shape is seen in broken lines in FIG. 4 and the shape after forming the bend 32 is seen in full lines. Widely available numerically controlled equipment can be used to form the bend 32. Because the bending operation is performed on round tube, the bend can be relatively sharp. In a preferred embodiment of the invention the radius of curvature of the bend 32 is about one and one-half inches relative to the centerline of the tube 50. Although a single ninety degree bend is illustrated, single or compound bends of any desired angle can be made to tailor the manifold tube 22 and assembly 20 to any specific range application. Because a round tube can be bent in any plane, great flexibility in design is possible.

After the bending operation, although the configuration of the tube is changed, the tube retains a substantially circular cross section and a substantially uniform wall thickness throughout its length, with only minor variations at the bend 32 resulting from deformation during the bending operation. Thus at this point in the manufacturing process, the entire tube length retains essentially the cross section seen in FIG. 2.

The next step in forming the tube 22 is to flatten the cross section of that part of the tube 50 other than the circular section 44, specifically including the non-circular segment 46 and the end portion that is to become the closed end 26. Tooling for forming the non-circular cross section seen in FIGS. 4 and 5. An elongated mandrel 52 is inserted into the front tube portion 34 and the tube and mandrel 52 are placed between a tool 54 having a recess 56 and a mating tool 58. The mandrel 52 and the tools 54 and 58 extend throughout the entire axial length of the part of the tube 50 that is to be provided with the non-circular cross section of FIG. 3.

As seen by comparing FIGS. 4 and 5, when the tools 54 and 58 are closed together over the tube 50 and the mandrel 52, the tube is deformed so that it no longer has a circular cross section, but instead has a non-circular cross section as seen in FIG. 3. This non-circular cross section includes a pair of opposed, parallel, flat tube wall portions 60 and 62 separated by opposed, curved wall portions 64 and 66. It is preferred that the curved portions 64 and 66 are undeformed, radially outwardly displaced sections of the initial round cross section of the tube 50. In the resulting cross sectional shape, the flat portions 60 and 62 are spaced apart by a distance smaller than the diameter of the original circular cross sectional shape and the curved portions 64 and 66 are separated by a distance larger than the diameter of the original circular cross sectional shape. If desired, the upper flat portion 60 may be wider than the lower flat portion 62 to provide a larger area for mounting of the valves 28 and 30.

Figure 7:
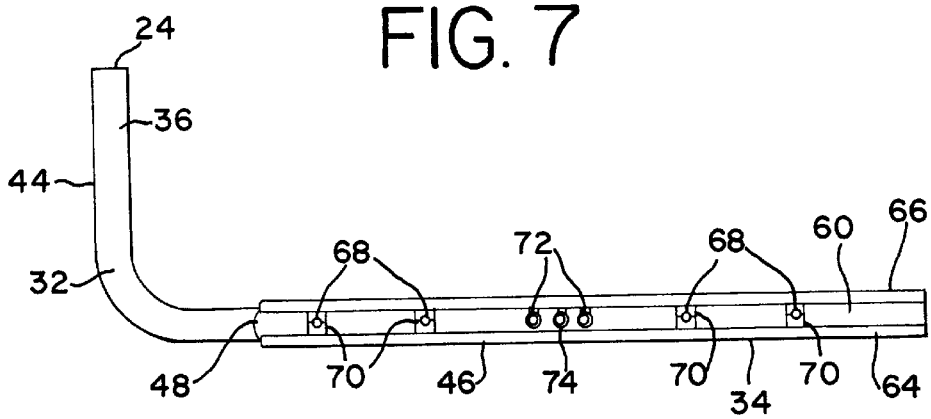
FIG. 7 is a top plan view of the manifold tube in a subsequent stage in the process of manufacturing the manifold tube.

The next step in manufacturing the manifold tube 22 is to provide circular holes 68 and square holes 70 for mounting of the burner valves 28, holes 72 for mounting the oven control valve 30 and a hole 74 for admitting gas to the oven control valve 30. The holes 68, 70, 72 and 74 are preferably made by punching through the wall of the tube 22 with punches of corresponding size and shape. The holes 70, the hole 74 and two holes 72 are made in the upper flat wall portion 60. The holes 68 and the remaining two holes 72 are made in the lower flat wall portion 62. A mandrel can be inserted into the tube to support the tube during the punching operations. It is preferred that the holes 68 are made before the holes 70 to reduce the possibility of the removed material remaining in the tube. FIG. 7 illustrates the manifold tube 22 at this stage of manufacture with the non-circular cross section formed and with the holes 68–74 formed in the tube wall portions 60 and 62.

Figure 8:
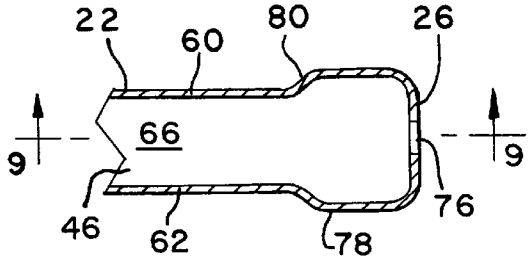
FIG. 8 is an enlarged, fragmentary, cross sectional view of the closed end of the manifold tube taken along the line 8—8 of FIG. 1.
Figure 9:
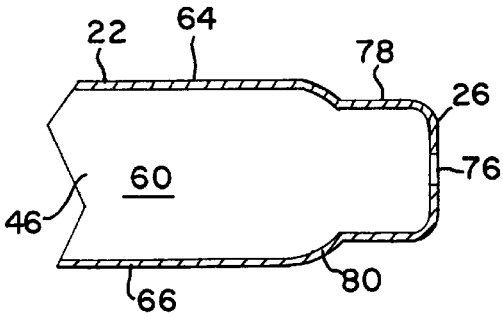
FIG. 9 is a cross sectional view of the closed end of the manifold tube taken along the line 9—9 of FIG. 8.

After the manifold tube 22 is formed and punched as seen in FIG. 7, the closed end 26 is formed. Before closing the end of the tube 22, a short end segment is returned from the non-circular cross section shape seen in FIG. 3 to the circular cross section shape seen in FIG. 2. Preferably this is done by closing a mating pair of circular clamps over the end portion of the tube 22. After the circular end segment is prepared, the tube wall material at the end of the tube is shaped into a flat, radial end wall 26. Preferably the end wall 26 is formed by rotating the tube 22 around the axis of the front portion 34 and displacing the tube wall material radially inwardly in a metal spinning operation. To assure a gas tight seal at the center of the end wall 26, a central region 76 is welded to puddle molten material which hardens in a gas impervious body. As best seen in FIGS. 8 and 9, when the reshaping and closing of the end segment is completed, the end portion of the tube 22 includes a short round segment 78, preferably not longer than about one inch, having a circular cross section as well as a transition portion 80 separating the round segment 78 from the non-circular segment 46.

Figure 10:
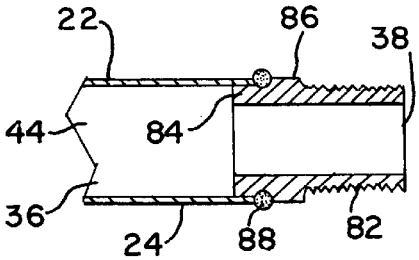
FIG. 10 is an enlarged, fragmentary, cross sectional view of the inlet portion of the manifold assembly taken along the line 10—10 of FIG. 1.

The inlet fitting 38 is used to connect the manifold assembly 20 to a threaded fitting communicating with a gas supply. The fitting 38 as seen in FIG. 10 includes a threaded nipple portion 82, a sleeve 84 that is received in the end of the tube 22, and a flange 86 that abuts the end of the tube 22. Because the inlet end of the tube is part of the circular segment 44 and has a circular cross section (FIG. 2) the sleeve 84 has a simple circular cross section and the fitting 38 is an inexpensive machined part. The fitting is welded to the end of the tube 22 and the resulting weld bead 88 holds the fitting 38 securely in place and provides a gas tight seal.

Figure 11:
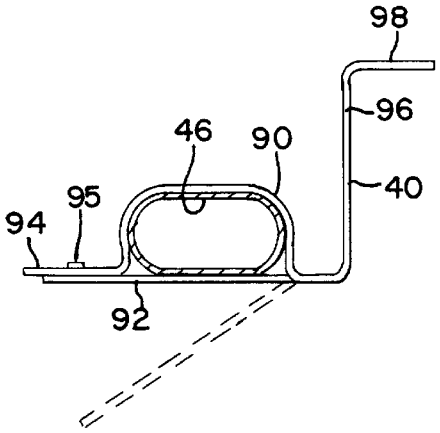
FIG. 11 is an enlarged, partly sectional view taken along the line 11—11 of FIG. 1 illustrating a support bracket attached to a flattened segment of the manifold tube.

The brackets 40 and 42 are used to support the manifold assembly 20 in a range. As seen in FIGS. 1 and 11, bracket 40 is a stamped and formed sheet metal part having a tube receiving section 90 shaped to received the non-circular cross section of the non-circular segment 46 of the tube 22. An integral strap portion 92 partly severed from the main body is initially formed into the position seen in broken lines in FIG. 11. When the section 90 is in place on the tube 22, the strap portion 92 is moved to the position seen in full lines in FIG. 11 and is attached to a base portion 94 of the bracket. Although various fastening methods could be used, it is preferred that the strap 92 and base 94 are joined by a TOX® formed connection 95 made with "rivetless rivet" apparatus available from TOX® Pressotechnik L.L.C., 730 Racquet Club Drive, Addison, Ill. 60101. Capturing the non-circular section 46 of the tube 22 between the section 90 and strap 92 firmly anchors the bracket 40 in place. The bracket 40 includes a leg portion 96 and a mounting flange portion 98 positioned to be connected to a mounting point in a range in which the manifold assembly 20 is to be supported.

Figure 12:
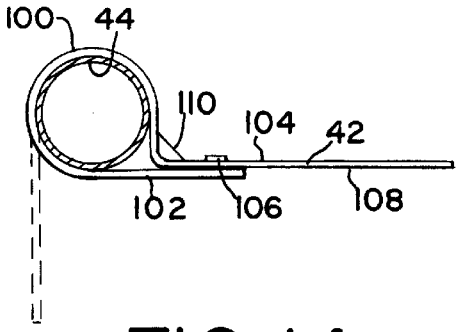
FIG. 12 is an enlarged, partly cross sectional view taken along the line 12—12 of FIG. 1 illustrating a support bracket attached to a round segment of the manifold tube near the inlet portion of the manifold assembly.

As seen in FIGS. 1 and 12, bracket 42 is also a stamped and formed sheet metal part having a tube receiving section 100 shaped to received the circular cross section of the circular segment 44 of the tube 22. An integral strap portion 102 partly severed from the main body is initially formed into the position seen in broken lines in FIG. 12. When the section 100 is in place on the tube 22, the strap portion 102 is moved to the position seen in full lines in FIG. 12 and is attached to a base portion 104 of the bracket. Although various fastening methods could be used, it is preferred that the strap 102 and base 104 are joined by a TOX® formed connection 106 made with "rivetless rivet" apparatus available from TOX® Pressotechnik L.L.C., 730 Racquet Club Drive, Addison, Ill. 60101. Capturing the tube 22 between the section 100 and strap 102 firmly anchors the bracket 42 in place. The bracket 42 includes an extending mounting leg portion 108 positioned to be connected to a mounting point in a range in which the manifold assembly 20 is to be supported. A pair of gussets 110 provide strength at the intersection of the base portion 104 and the tube receiving section 100.

Figure 14:
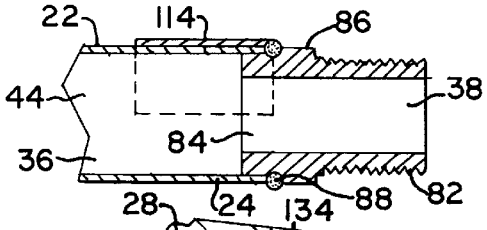
FIG. 14 is a view like FIG. 10 and also is an enlarged sectional view taken along the line 14—14 of FIG. 13 illustrating the attachment of the support bracket of FIG. 13 to the inlet portion of the manifold assembly.
Figure 13:
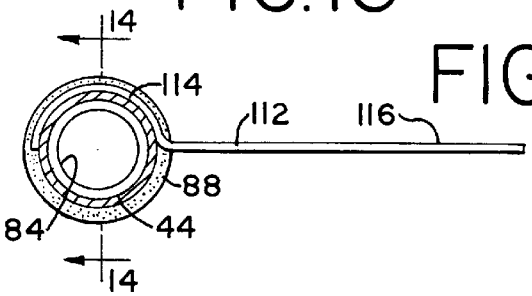
FIG. 13 is a cross sectional view illustrating an alternative form of support bracket for the inlet portion of the manifold assembly.

FIGS. 13 and 14 illustrate an alternative mounting bracket 112 that can be used to support the inlet section of the manifold tube 22. The bracket 112 includes a tube receiving section 114 having a semi-circular shape that receives the circular cross section of the circular segment 44 of the tube 22. The semi-circular tube receiving section 114 is placed over the inlet end of the tube 22 abutting against the flange 86 of the inlet fitting 38 before the inlet fitting is welded in place. When the fitting 38 is welded into place, the weld bead 88 performs an additional function of attaching the semi-circular section 114 of the mounting bracket 112 to the tube 22. The bracket 112 includes an extending mounting leg 116 positioned to be connected to a mounting point in a range in which the manifold assembly 20 is to be supported.

Figure 15:
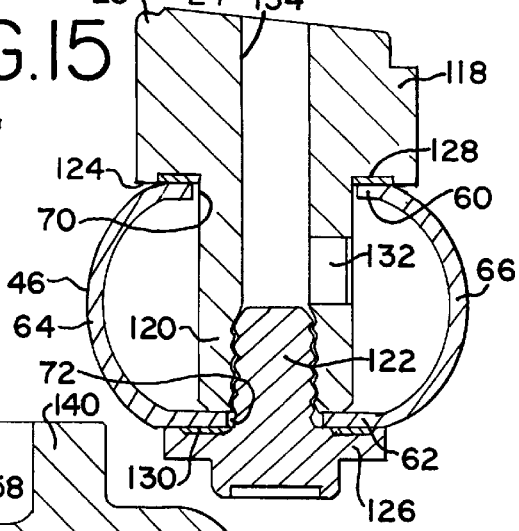
FIG. 15 is an enlarged, fragmentary, cross sectional view taken along the line 15—15 of FIG. 1 illustrating the attachment of a burner valve body to the manifold tube.

FIG. 15 illustrates the mounting of a burner valve 28 to the manifold tube 22. The burner valve 28 has a valve body 118 with a mounting stem 120 extending through the opening 70 in the flat tube wall 60. The outer shape of the stem 120 is square and matches the square shape of the opening 70 to provide a keyed, anti-rotational fit. A screw 122 is received through the opening 72 in the wall 62 and threads into the stem 120.

The distance between a shoulder 124 on the body 118 and the tip of the stem 120 is equal to or very slightly smaller than the distance between the upper surfaces of the walls 60 and 62. When the screw 122 is tightened, a cap 126 of the screw bottoms out against the tube wall, capturing the wall 62 between the cap 126 and the stem 120 and the shoulder 124 bottoms out against the upper surface of the wall 60. These contact regions provide metal-to-metal contact as the screw 122 is threaded into the stem 120 and reaches its fully tightened position. At this point, an abrupt increase of tightening torque is encountered and is easily detected as an indication of full tightening of the screw 122. The rigid metal-to-metal contact between the screw cap 126 and the tip of the stem 120 through the wall 60 prevents over tightening which could otherwise deform the tube 22 by moving the walls 60 and 62 toward one another.

A pair of seals 128 and 130 are captured in recesses in the shoulder 124 and cap 126 respectively. The seals are compressed and captured when screw 122 is tightened to prevent leakage of gas from the manifold assembly. Capturing of the seals 128 and 130 prevents creep of the seal material due to temperature and/or pressure. Gas is admitted to the burner valve 28 through a radial passage 132 in the stem 120 and a passage 134 extending upward into the valve body 118. As seen in FIG. 1, each burner valve 28 includes a fitting 136 for connection to a conduit supplying gas to a top burner and an operating stem 138 intended to be rotated by a knob (not shown) for turning an internal valve member and controlling the admission of gas from the passage 134 to the fitting 136.

Figure 16:
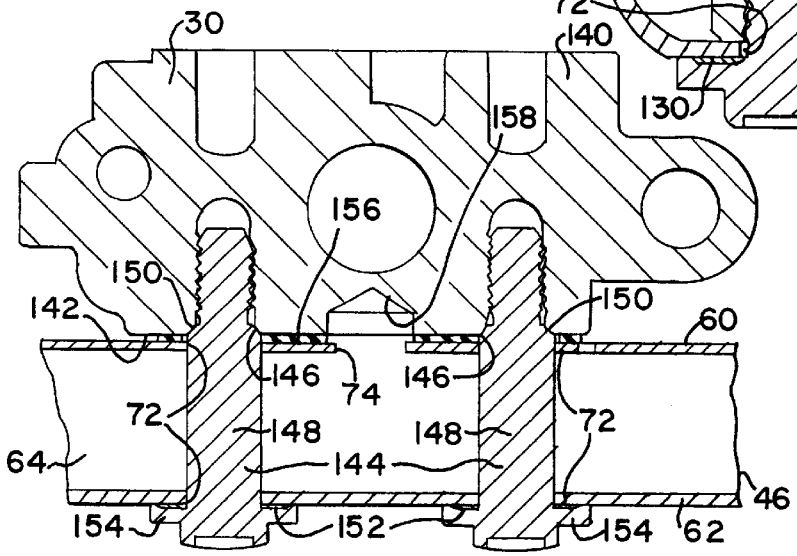
FIG. 16 is an enlarged, fragmentary, cross sectional view taken along the line 16—16 of FIG. 1 illustrating the attachment of a thermostatic control valve body to the manifold tube.

FIG. 16 illustrates the attachment of the thermostat oven control valve 30 to the non-circular segment 46 of the manifold tube 22. The control valve 30 includes a valve body 140 having a flat face 142 overlying the top surface of the flat tubing wall portion 60. A pair of screws 144 extend through the aligned openings 72 in the walls 62 and 60 and are threaded into the valve body 140. Shoulders 146 on shank portions 148 of the fasteners 144 engage with metal-to-metal contact against seats 150 on the face 142 when the fasteners 144 are fully tightened. Seals 152 are captured in cavities under cap flanges 154 of the fasteners 144, and another seal gasket 156 is sandwiched between the flat face 142 and the tubing flat wall portion 60. Gas is admitted to the control valve 30 through the opening 74 and a passage 158 in the valve body 140. As seen in FIG. 1, the oven control valve includes an outlet fitting 160 for supplying gas to a conduit extending to a range oven burner. An oven pilot burner is supplied with gas through a pilot fitting 162. A conduit 164 extends to a temperature sensor located in the range oven for returning a temperature feedback signal to the control valve 30. An operating stem 166 can be rotated by a knob (not shown) to operate an internal assembly to admit gas to the outlet fitting 160 and to control the gas flow to maintain a selected oven temperature.

The distance between the shoulders 146 and the cap flanges 154 of the screws 144 is equal to or very slightly smaller than the distance between the outer surfaces of the walls 60 and 62 minus the compressed thickness of the gasket 156. When the screws 144 are tightened, the metal-to-metal contact between the shoulders 146 and seats 150 results in an abrupt increase in torque that is easily detected and provides an indication of completion of the assembly. The rigid metal to metal contact prevents over tightening which could otherwise deform the tube 22 by moving the walls 60 and 62 toward one another or which could otherwise result in over compression of the seal gasket 156.

While the present invention has been described with reference to the details of the embodiments of the invention shown in the drawing, these details are not intended to limit the scope of the invention as claimed in the appended claims.

What is claimed is:

1. A manifold assembly for a gas range comprising:

a thin wall metal tube forming an elongated gas conduit having an inlet end and a closed end;

at least one valve mounted on said conduit for controlling the flow of gas from said conduit;

said manifold assembly being characterized by:

said tube having a first segment along its length, said first segment having a circular cross section with a diameter; and said tube having a second segment along its length, said second segment having a non-circular cross section with opposed first and second wall portions alternating with opposed third and fourth wall portions;

said first and second wall portions being flat and parallel to one another said first and second wall portions being spaced apart by a distance less than said diameter of said first segment and said third and fourth wall portions being spaced apart by a distance greater than said diameter of said first segment; and said at least one valve being mounted to said second segment of said tube.

2. A manifold assembly as claimed in claim 1, said at least one valve comprising a plurality of valves.

3. A manifold assembly as claimed in claim 2, said plurality of valves including a plurality of burner valves.

4. A manifold assembly as claimed in claim 3, said plurality of valves including a thermostatic oven control valve.

5. A manifold assembly as claimed in claim 1, said first segment being adjacent to said inlet end, and said second segment being between said first segment and said outlet end.

6. A manifold assembly as claimed in claim 5, said tube having a bend and said bend being located in said first segment.

7. A manifold assembly as claimed in claim 6, said second segment being straight and free of bends.

8. A manifold assembly as claimed in claim 1, said closed end comprising a radial end wall formed of the metal of said tube.

9. A manifold assembly as claimed in claim 8, said end wall further including a welded portion at the center of said radial end wall.

10. A manifold assembly as claimed in claim 5, further comprising an inlet fitting attached to said inlet end of said tube, said inlet fitting having a sleeve mating with said first segment of said tube, said sleeve having a circular cross section.

11. A manifold assembly as claimed in claim 10 further comprising a weld bead encircling said inlet end of said tube attaching said inlet end to said inlet fitting.

12. A manifold assembly as claimed in claim 11 further comprising a mounting bracket attached to said inlet end of said tube, said mounting bracket having a tube receiving section attached to said inlet end by said weld bead.

13. A manifold assembly as claimed in claim 1 further comprising a first mounting bracket attached to said first segment of said tube and a second mounting bracket attached to said second segment of said tube, said mounting brackets having tube receiving portions shaped to receive said circular and non-circular cross sections respectively.

14. A manifold assembly as claimed in claim 1, said at least one valve including a valve body fastened against said first wall portion.

15. A manifold assembly as claimed in claim 14, said valve body threadedly receiving a fastener extending through said second wall portion.

16. A manifold assembly as claimed in claim 1, said first and second wall portions having aligned valve mounting holes, said valve being mounted against one of said first and second walls, a threaded fastener extending into said valve mounting hole in the other of said first and second walls, and means providing an essentially rigid metal-to-metal contact between said fastener and said valve in a fully tightened position of said fastener.

17. A manifold assembly as claimed in claim 16, said metal-to-metal providing means including a portion of one of said first and second wall portions.

18. A manifold assembly as claimed in claim 16, said metal-to-metal providing means including directly abutting portions of said fastener and said valve.

19. A manifold assembly as claimed in claim 16, further comprising a seal gasket compressed between said valve and said one of said first and second walls.

20. A manifold tube for a gas range manifold assembly, said manifold tube comprising:

a thin wall metal tubular body having a first segment with a circular cross section uniform throughout the length of said first segment, said circular cross section having a diameter;

said body having an inlet at one end of said first segment;

said body having a second segment with a non-circular cross section uniform throughout the length of said second segment;

said non-circular cross section including opposed parallel top and bottom flat wall portions spaced apart by a distance less than said diameter, and including opposed side wall portions spaced apart by a distance greater than said diameter; and at least one valve mounting opening in at least one of said top and bottom walls.

21. The manifold tube of claim 20 further comprising a bend in said body, said bend being located in said first segment.

* * * * *